US006942559B2

(12) United States Patent
Klotz

(10) Patent No.: US 6,942,559 B2
(45) Date of Patent: Sep. 13, 2005

(54) POLISHING DEVICE

(76) Inventor: Peter Klotz, Gustav-Schultze-Str. 27b, 33102, Paderborn (DE)

( * ) Notice: Subject to any disclaimer, the term of this patent is extended or adjusted under 35 U.S.C. 154(b) by 7 days.

(21) Appl. No.: 10/731,896

(22) Filed: Dec. 9, 2003

(65) Prior Publication Data

US 2004/0147210 A1 Jul. 29, 2004

(30) Foreign Application Priority Data

Dec. 10, 2002 (DE) ..... 102 57 687

(51) Int. Cl.[7] ..... B24B 23/00

(52) U.S. Cl. ..... 451/358; 451/344; 451/359; 451/463; 451/508

(58) Field of Search ..... 451/358, 344, 451/354, 463, 465, 508, 466, 487, 489, 359, 259, 353, 509; 81/185

(56) References Cited

U.S. PATENT DOCUMENTS 2,146,548 A * 2/1939 Mitschang et al. ..... 451/510
3,728,827 A * 4/1973 Koppenwallner ..... 451/342
4,455,788 A * 6/1984 Freerks ..... 451/466
4,577,526 A * 3/1986 Stabler ..... 74/609
4,774,788 A 10/1988 Shacham et al.
4,924,634 A * 5/1990 MacKay, Jr. ..... 451/342
5,020,280 A * 6/1991 O'Reilly ..... 451/342
5,152,106 A * 10/1992 MacKay, Jr. ..... 451/342
5,269,874 A * 12/1993 Winter ..... 156/584
5,386,667 A * 2/1995 Hausslein et al. ..... 451/344
5,405,286 A * 4/1995 Welsch ..... 451/527
5,895,317 A * 4/1999 Timm ..... 451/548
6,116,996 A * 9/2000 Yanase ..... 451/359
6,332,836 B1 * 12/2001 Tseng ..... 451/359
6,339,980 B1 * 1/2002 Woolf ..... 81/185.1
6,379,238 B1 * 4/2002 Beechey et al. ..... 451/532

FOREIGN PATENT DOCUMENTS

DE 1 884 208 12/1963

* cited by examiner

*Primary Examiner*—George Nguyen
(74) *Attorney, Agent, or Firm*—Brown Raysman Millstein Felder and Steiner

(57) ABSTRACT

The polishing device has a shank and at least one polishing disk arranged on one end of the shank, that can be friction-fixed by two stops one opposite another. The polishing device has a protective element preventing contact between the surface to be polished and the shank end or stop.

17 Claims, 3 Drawing Sheets

POLISHING DEVICE

DESCRIPTION

The present invention concerns a polishing device having a shank and at least one polishing disk that is arranged on one end of the shank and can be friction-fixed by two stops/bosses opposite one another.

There is already a great variety of polishing devices for surface treatment. For example, felt disks, buffing disks or polishing disks are used for polishing a great variety of surfaces. Polishing disks are usually made of several layers of cloth, flat or bodied up, superimposed or stitched, to achieve surface lustre through rubbing caused by rotating polishing disks.

Known are, for example, polishing devices in which the polishing body is composed of a number of superimposed and stitched cotton cloths that are arranged radially from a drill hole of a mounting arbor or screw arbor or other. In another embodiment, the polishing elements are glued to the surface surrounding a core or to a disk of a rotating work head.

Such polishing devices have the advantage that they can be used irrespective of the surface to be polished and the shape of the work piece. Even sensitive surfaces such as piano varnishes, automobile varnishes, furniture surfaces or other can be polished.

The drawback, however, is the risk that the surfaces to be polished are scratched or damaged by the ends of the mounting arbors, screw arbors or rotating shanks, especially in the event something "slips".

From the German utility model DE 1 884 208 there is already known a device making use of a protective layer affixed to the nut, said layer being able to be pinched at the circumference of said nut. To unscrew the nut a specific tool can be introduced into the nut, holes being provided in corresponding positions.

BRIEF SUMMARY OF THE INVENTION

The object of the present invention is to improve the above-mentioned polishing devices and to prevent any damage or scratching of the surface to be polished, in a simple and cost effective manner.

According to the invention, this object is achieved by the characteristics of the independent claim 1, useful variations of the invention being described by the characteristics of the subclaims. The scope of the invention is not limited to the characteristics of the individual claims, but also extends to their combinations.

In particular, the present invention represents a polishing device having a shank and, at least one polishing disk on one end of the shank, that can be friction-fixed by two stops opposite one another, with a protective element, that is provided with at least one passageway allowing to pinch it together with said polishing disk in a radially secured manner and preventing the contact between the surface to be polished and the shank end or the stop. The protective element extends axially beyond the stop and the shank end, so that direct contact with the surface to be polished is prevented. This way, damage and particularly scratches are avoided. For example, the shank can be a threaded shaft, and the stops can be nuts. This arrangement ensures friction-fixed attachment of the polishing disks. The polishing disks are slipped onto the shank through openings and friction-fixed by means of the two stops. Another advantage of the polishing disk according to the invention is that it can be produced in a simple and cost-effective fashion.

In a preferred embodiment, the protective element is a bushing made of plastic having a flange on one side. For example, the plastic bushing can be simply and cost-effectively produced by die casting. In addition, a plastic bushing is particularly heat-resistant and chemical-resistant. On the one hand, the plastic bushing protects the surface to be polished, on the other hand, it allows to access the shank end.

The flange is preferably shaped with ribs on at least one side. This form provides improved power transmission and fixation of the polishing disks; as well, air can circulate through the hollow spaces between the ribs, thus diffusing heat. This way, the protective element is cooled and damage avoided.

An additional advantage is that on the inside, the flange is thicker towards the axis of rotation than on the outside. Different thickness in material improves the mechanical properties of the protective element, particularly in a radial and axial direction. This also greatly increases the stability of the bushing.

In addition, there is a ledge inside the bushing, in particular a circumferential ledge for locking in the shank end. This form, on the one hand, helps prevent the loss of the plastic bushing during assembly or disassembly and, on the other hand, facilitates the initial attachment of the protective element to the shank.

In another preferred embodiment, the bushing is made essentially of elastic material to protect the surface to be polished, and the flange is made essentially of a non-elastic material to fix the polishing disks. The protective element can be produced in a two-component process in a simple and cost-effective manner. For example, the bushing is made of elastic plastic, so that even if the bushing comes in contact with the surface to be polished, any damage or scratching is avoided. When assembling and securing the polishing disks, it is advantageous to have a flange made of non-elastic plastic.

In an alternative advantageous embodiment, the protective element is made of the same material as the polishing disk, in particular in the shape of a material sheeting having openings at its ends for the shank to be passed through. The material sheeting is attached through the openings via the shank end or the stop, particularly in the form of a loop, so that any direct contact with the surface to be polished is avoided. A particular advantage here is that no additional material or substance is needed and that polishing can be performed across the entire surface of the element to be polished. This makes the polishing process substantially easier, as this excludes any damage caused by the shank end or the stop/boss.

Advantageously, the protective element can be attached in a friction-fixed manner between the stop at the shank end and the polishing disk. For example, the stop can be a nut that is screwed onto a threaded shaft. This ensures the friction-fixed attachment of the protective element in a simple manner, and the protective element can be exchanged by unscrewing the nut.

Another advantage is that the protective element encompasses the shank end with some play, this arrangement allowing to axial access the distal shank end to release the friction attachment. The polishing disks can thus be exchanged in a simple and quick manner. The polishing disks are particularly made of viscose. This allows to wash the polishing disks, for example after use, and then to use them again.

What is more is that the polishing device, because of a plurality of polishing disks, has essentially a cylindrical, truncated cone-like, drum-shaped, belly-like form, or a cylindrical form having a hollow groove in the outer polishing area. A shape of this kind allows to polish even such surfaces that are difficult to access or complex surfaces such as depressions, holes or the like.

In addition, in a preferred embodiment, the shank is a screw bolt, one stop encompassing the head end and the second stop encompassing a nut. For example, the first things that can be slipped over the screw bolt are the plastic bushing or the two openings of the material sheeting, followed by the polishing disks that are slipped through the openings. The polishing disks are friction-fixed by means of a nut. Such an arrangement allows fast and effective assembly of the polishing device. The polishing device can be disassembled and the polishing disks be exchanged and others mounted at any tine.

Eventually, the polishing device can be set in rotation in particular by means of a tool machine that can be connected to the shank, the rotation movement allowing independent fixation of the polishing disks. In particular, the tool machine can be attached to an oblong nut. The rotation movement makes available an independent fixation of the nut or the polishing disks, the nut providing better protection against rotation than a cylindrical shank.

Other advantages and characteristics of the present invention also become evident from the descriptions of presently preferred embodiments which are referred to in the annexed figures. These figures have only an exemplary value and do not limit the invention in any way.

DETAILED DESCRIPTION OF THE INVENTION

Figure 1:
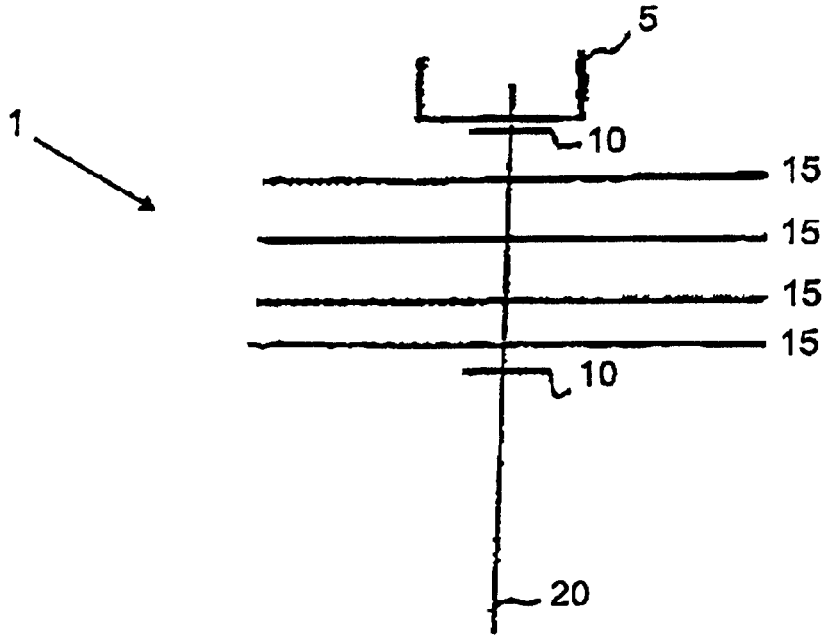
FIG. 1 is a first preferred embodiment of the polishing device according to the invention.

FIG. 1 shows a preferred embodiment of the polishing device 1 according to the invention. The polishing device 1 shown here consists of a shank 20, for example in the shape of a screw, polishing disks 15, two stops 10, and a protective element 5. The shank 20 is a shaft, in particular a threaded screw. The stop 10 is in the shape of a nut (with a washer, if applicable). However, it could also be a head of a screw bolt. The polishing disks 15 can be slipped through openings onto the screw 20 and fixed by means of the stop 10 which, in the present case, is a nut. The protective element 5 extends beyond the shank 20 and the stop, thus preventing direct contact with the surface to be polished. The stop at the distal end of the shaft 20 can also be in the shape of a cantilever.

Figure 2:
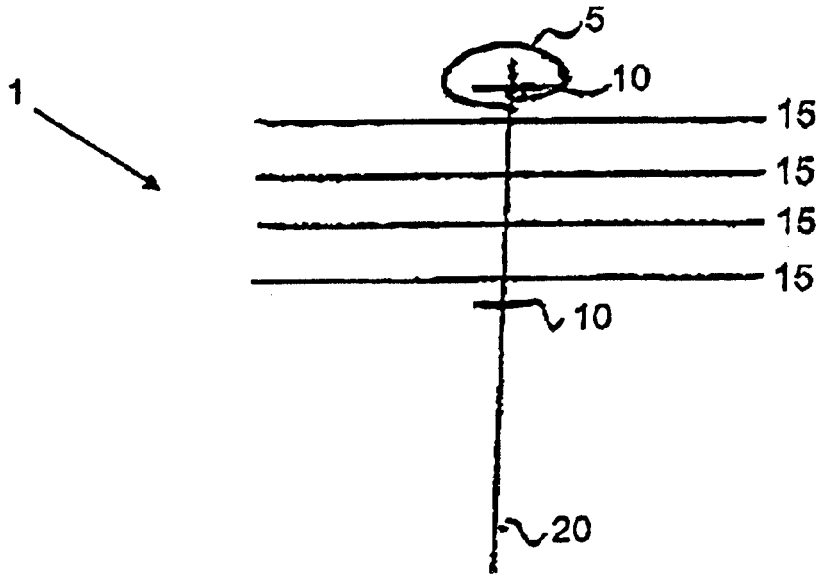
FIG. 2 is another preferred embodiment of the polishing device according to the invention.

FIG. 2 shows another preferred embodiment of the polishing device 1 according to the invention. The protective element 5 in this embodiment is a material sheeting made, in the present case, of the same material as the polishing disks 15. On both ends of the material sheeting are openings for inserting the shank 20. For this purpose, first an opening of the material sheeting is slipped over the screw 20, followed by the second opening, so that the material sheeting extends axially beyond the end of the shank or screw 20. This way, protection is provided even if the polishing device 1 should slip on the surface, thus avoiding the risk of scratching.

Figure 3:
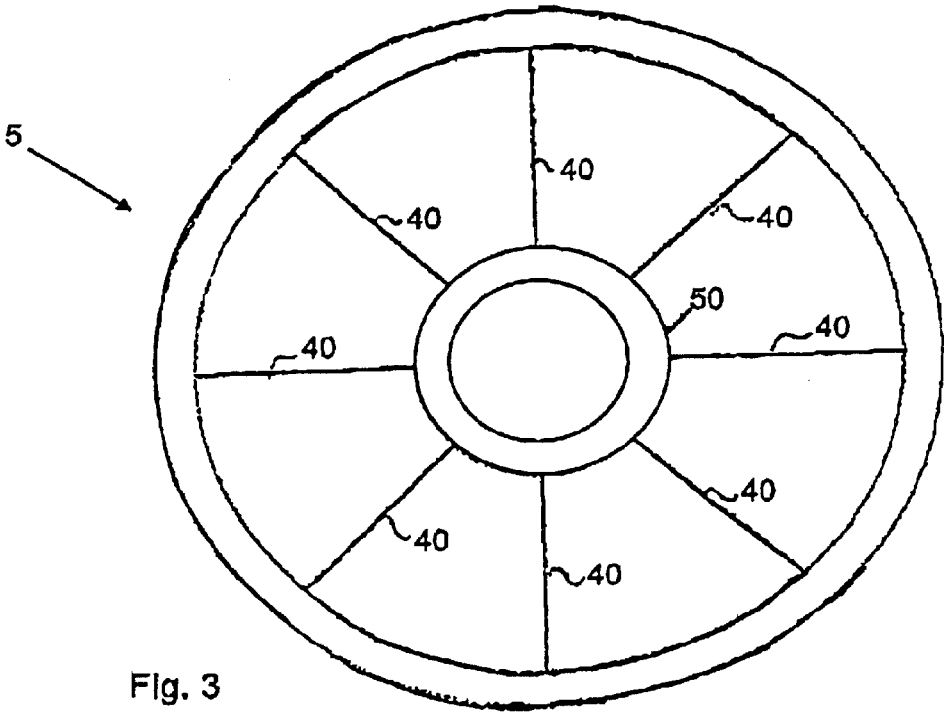
FIG. 3 is a frontal view of a protective element such as it can be used in the embodiment shown in FIG. 2.

FIG. 3 is a frontal view of the protective element 5 in FIG. 1. The protective element is a bushing 25 with a flange 30, the entire element being made of plastic. The protective element 5 can also be made of different components, in particular metal, plastic or similar material. The shank or the screw bolt 20 is slipped through the hole 50 in the bushing 25 and fixed by means of the head of the screw 20. The protective element 5 extends beyond the screw 20, protecting the surface to be polished. Inside the bushing 25, either on one side or on both sides, ribs or bars 40 are arranged on the flange 30, allowing air passage and dissipating friction-induced heat. The bars 40 are aligned towards the axis of rotation. This also improves the friction attachment of the polishing disks 15. The bushing 25, for example, is made by two-component die casting. For this, an elastic material is selected for the bushing 25, to protect the surface to be polished. The flange 30 consists of a relatively non-elastic material, to provide fixation when mounted. The bushing 25 can also be made of plastic, and the flange 30 of metal. The material of the flange 30 is thicker on the inside than on the outside, to increase the stability of the flange 30, so that it is also possible to provide high pre-tensioning for the polishing device.

Figure 4:
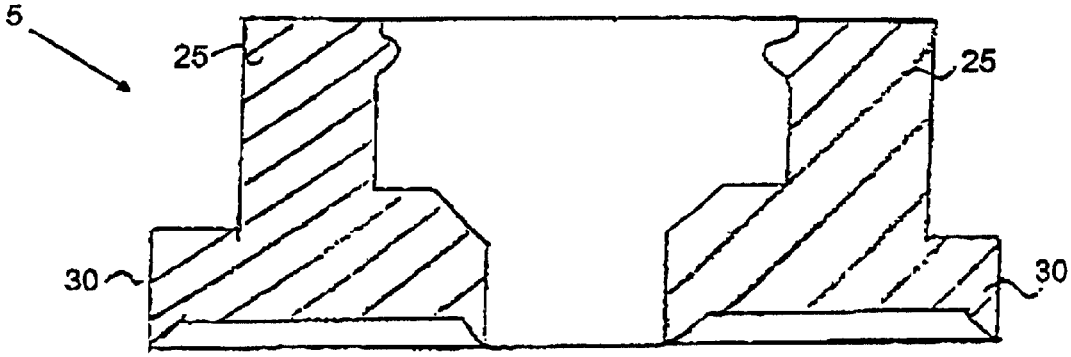
FIG. 4 is a sectional view of the protective element shown in FIG. 3.

FIG. 4 is a sectional view of the protective element 5 in FIG. 1. Identical parts are given identical reference numbers. On the inside of the bushing 25, there is a ledge or shoulder 35 for locking the shank end, in particular a circumferential ledge 35. The ledge 35 creates a disconnectable link, having some play with the screw 20. On the inside, the flange 30 is bevelled towards the axis of rotation. This makes it easier to insert the shank 20 through the hole 50 and friction-induced heat can be dissipated.

Figure 5:
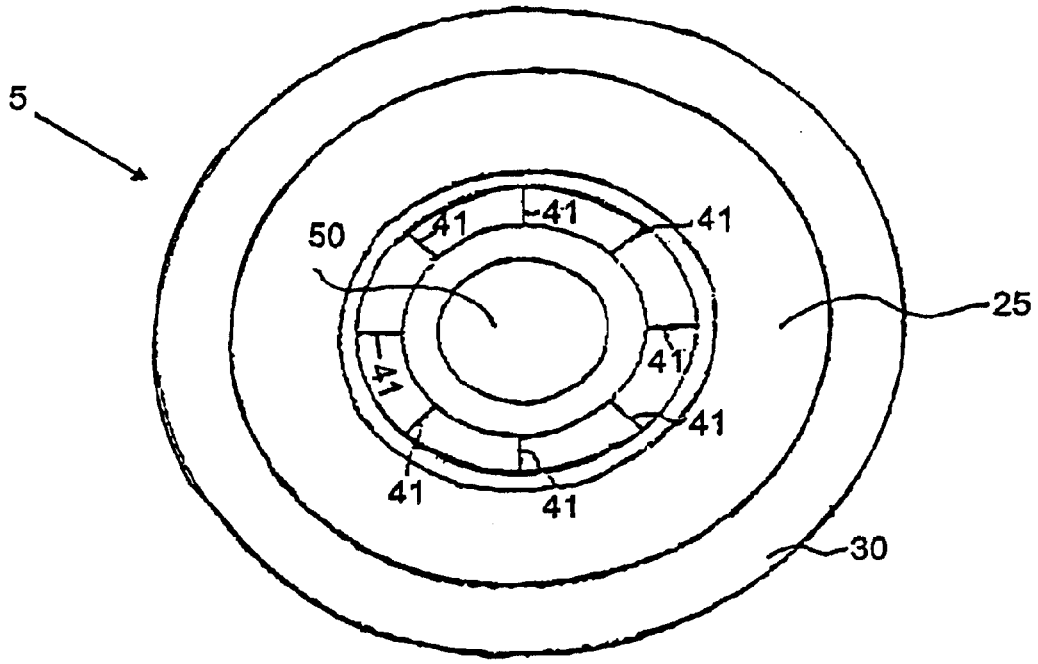
FIG. 5 is a top view of the protective element shown in FIG. 4.

In addition, FIG. 5 shows a top view of the protective element 5 in FIG. 2. Identical parts are given identical reference numbers. This view shows the structure of the protective element 5 particularly well. For example, if one introduces a screw bolt, the hole 50 should correspond approximately to the threaded section, the screw head being guided inside the bushing by means of the bars 41 so as to attach the flange to the polishing disks below (not shown).

Figure 6:
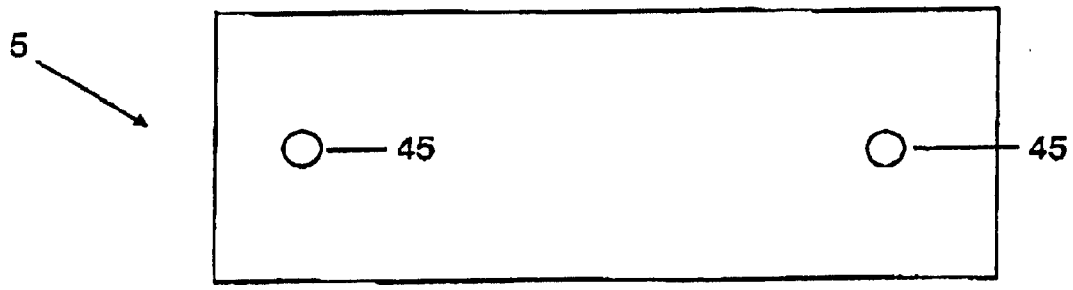
FIG. 6 is a frontal view of a protective element such as it can be used in the embodiment shown in FIG. 2.

Finally, FIG. 6 is a frontal view of a protective element 5 such as it is used in the embodiment shown in FIG. 2. The protective element 5 is a material sheeting made of the same material as the polishing disks 15. Openings 45 for inserting the shank 20 are arranged on either side of the material sheeting. For this purpose, first an opening 45 of the material sheeting is slipped over the screw 20, followed by the second opening 45, so that the material sheeting extends axially beyond the end of the screw 20. Then the polishing disks 15 are slipped through the openings 45 on the screw 20 and subsequently fixed by means of a nut 10. In the case of a screw 20, the material sheeting has at least the same length as the screw 20, so that this can be slipped through the openings 45 over the screw head. If for example, one uses a shaft with two nuts for stops, the polishing disks 15 can first be slipped through the openings 45 onto the shaft. The material sheeting must only be sufficiently long to encompass the stop 10 and the flange 20. Fixing of the polishing disks 15 is done by means of the two nuts. This way, accessing the shank end is possible at any time and the friction-fixed connection can be easily released, for example, for changing the polishing disks 15.

Although the present invention has been completely described with reference to presently preferred embodiments, the man of the art should be aware that different variations are possible within the scope of the annexed claims, without deviating from the concept according to the invention and the protection claimed.

For example, is also possible to combine the described protective elements. What is relevant in the end is that protection has been substantiated in an effective manner and that, at the same time, accessing the shank end is possible, for example, for maintenance.

What is claimed is:

1. Polishing device having a shank and at least on one end of the shank one polishing disk that can be friction-fixed by two stops one opposite another, characterized in that there is a protective element, that is provided with at least one passageway, the protective element being friction-fixed by said two stops one opposite another together with said polishing disk in a radially secured manner and preventing any contact between the surface to be polished and the shank end or stop.

2. Polishing device according to claim 1, characterized in that the protective element is a plastic bushing having a flange on one side.

3. Polishing device according to claim 2, characterized in that at least one side of the flange bears ribs.

4. Polishing device according to claim 2, characterized in that on the inside, the flange is thicker towards the axis of rotation than on the outside.

5. Polishing device according to claim 2, characterized in that there is a ledge on the inside of the bushing, in particular a circumferential ledge for locking the shank end.

6. Polishing device according to claim 2, characterized in that the bushing is essentially made of elastic material to protect the surface to be polished, and that the flange is essentially made of non-elastic material to fix the polishing disks.

7. Polishing device according to claim 2, characterized in that the protective element can be friction-fixed between the stop at the shank end and the polishing disk.

8. Polishing device according to claim 1, characterized in that the protective element is made of the same material as the polishing disk, in particular in the shape of a material rail having openings on its ends, for inserting the shank.

9. Polishing device according to claim 1, characterized in that the protective element encompasses the shaft end with some play, the axial shank end being axially accessible to allow releasing the friction-attachment.

10. Polishing device according to claim 1, characterized in that a plurality of polishing disks have a shape essentially representing a cylinder, a cylinder in the shape of a hollow groove in the external polishing area, a truncated cone, or a ball.

11. Polishing device according to claim 1, characterized in that the shank is a screw bolt, the stop encompassing the head end of the screw bolt and the second stop encompassing a nut.

12. Polishing device according to claim 11, which can be set in rotation by means of a tool machine, characterized in that the rotation movement allows independent fixing of the polishing disks.

13. A polishing device comprising:

a shank;

a plurality of polishing disks arranged on the shank, said polishing disks being friction-fixed by two stops one opposite another; and a protective element with at least one passageway allowing the protective element to be friction-fixed by said two stops one opposite another together with said polishing disks in a radially secured manner and preventing any contact between the surface to be polished and the sank.

14. Polishing device according to claim 13, characterized in that the bushing is essentially made of elastic material to protect the surface to be polished, and that the flange is essentially made of non-elastic material to fix the polishing disks.

15. Polishing device according to claim 13, characterized in that said plurality of polishing disks have a shape essentially representing a cylinder, a cylinder in the shape of a hollow groove in the external polishing area, a truncated cone, or a ball.

16. Polishing device according to claim 13, characterized in that the shank is a screw bolt, the stop encompassing the head end of the screw bolt and the second stop encompassing a nut.

17. Polishing device according to claim 16, which can be set in rotation by means of a tool machine, characterized in that the rotation movement allows independent fixing of the polishing disks.

* * * * *